US006619609B2

(12) United States Patent
Cress

(10) Patent No.: US 6,619,609 B2
(45) Date of Patent: Sep. 16, 2003

(54) APPARATUS FOR SUPPORTING ARTICLES

(75) Inventor: David R. Cress, Janesville, WI (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 09/863,180

(22) Filed: May 23, 2001

(65) Prior Publication Data

US 2002/0175259 A1 Nov. 28, 2002

(51) Int. Cl.[7] ..... A47B 97/04
(52) U.S. Cl. ..... 248/447; 248/465.1; 248/447.1
(58) Field of Search ..... 248/465.1, 458, 248/447, 240, 240.4, 447.1, 447.2, 441.1; 108/32, 28, 233, 310, 313; 211/42, 43, 133.5, 144

(56) References Cited

U.S. PATENT DOCUMENTS

| | | | | | |
|---|---|---|---|---|---|
| 2,599,416 | A | * | 6/1952 | Saecker | 248/447 |
| 3,485,544 | A | * | 12/1969 | Beckerman | 312/248 |
| 4,109,889 | A | * | 8/1978 | Durket | 248/447 |
| 4,184,725 | A | * | 1/1980 | Spangler | 248/447 |
| 4,269,381 | A | | 5/1981 | Harms | 248/222 |
| 4,369,948 | A | * | 1/1983 | Krauss et al. | 248/441.1 |
| 4,460,145 | A | * | 7/1984 | Ando | 248/447 |
| 5,720,465 | A | | 2/1998 | Peltzer et al. | 248/453 |
| 6,068,299 | A | | 5/2000 | Peltzer | 281/45 |
| D436,628 | S | | 1/2001 | Goodman et al. | D19/91 |

FOREIGN PATENT DOCUMENTS

| | | | |
|---|---|---|---|
| JP | 2000-135128 | * | 5/2000 |

* cited by examiner

*Primary Examiner*—Gwendolyn Baxter
(74) *Attorney, Agent, or Firm*—Marshall, Gerstein & Borun LLP

(57) ABSTRACT

An apparatus for supporting articles is disclosed including a base having a first surface and a second surface, and a member rotatably coupled to the base. The member is configured to support an article, and the member may be selectively positioned between a first position and a second position by moving the member relative to the base. The first surface is configured to support the member in the first position, and the second surface configured to support the member in the second position.

26 Claims, 5 Drawing Sheets

APPARATUS FOR SUPPORTING ARTICLES

FIELD OF THE INVENTION

The present specification relates generally to an apparatus for supporting articles.

BACKGROUND OF THE INVENTION

In home or work environments such as kitchens, laboratories, workshops, assembly lines, etc., it is well known to provide articles such as papers, books or other various information sources for reference in conjunction with ongoing work. In a kitchen, for example, a recipe, cookbook or information sheet may often be referred to while preparing food. In a laboratory, a text book, instruction sheet, or notebook may be used while conducting a test or experiment. In such environments, it is important to have the various texts nearby and readily accessible for quick reference. However, such articles may take up a considerable or otherwise useful amounts of space on a work surface (e.g. counter top, desk top space, etc.). Moreover, the articles may also be exposed to (or contaminated with) compounds or ingredients used nearby.

It is known to provide a cookbook holder for holding a cookbook above a work surface. However, a disadvantage is such book holders tend to be stored in a first location when not in use, and set up in a second location when desired to be used. Another disadvantage of conventional book holders includes complexity of design (i.e. numerous parts) which increases production costs.

Accordingly, it would be advantageous to provide an apparatus which is easily stowed when not in use. It would also be advantageous to provide an apparatus which could be easily stowed in the same approximate location as it is used. It would further be advantageous to provide an apparatus having a relatively simple design that requires few parts, and thereby reduces production costs. Yet further still, it would be advantageous to provide an apparatus which is configured to elevate an article off of a work surface, thereby making the article easier to read or preview, increasing the available work space on a work surface, and removing the article from possible damage (such as staining) from dirt and debris in proximity to the work surface.

Accordingly, it would be desirable to provide an apparatus which provides one or more of these advantageous features. The techniques below extend to those embodiments which fall within the scope of the appended claims, regardless of whether they provide one or more of the above-mentioned advantageous features.

SUMMARY OF THE INVENTION

The present invention relates to an apparatus for supporting an article including a base having a first surface and a second surface, and a member rotatably coupled to the base. The member is configured to support an article, and the member may be selectively positioned between a first position and a second position by moving the member relative to the base. The first surface is configured to support the member in the first position, and the second surface is configured to support the member in the second position.

The present invention further relates to a holder including a first and second bracket, both brackets configured to be coupled to a bottom surface of a cabinet. The holder further includes first surfaces coupled to the first bracket and the second bracket, and second surfaces coupled to the first bracket and the second bracket. A member is rotatably coupled to the first and second bracket, and is configured to be selectively positioned between a first position and a second position. The first surfaces support the member in the first position, and the second surfaces support the member in the second position.

The present invention further relates to method of using a book holder including disengaging a book support in a stowed position from a base, rotating the book support from the stowed position to a use position, and engaging the book support in the use position with the base.

DETAILED DESCRIPTION OF EXEMPLARY EMBODIMENTS

Figure 1:
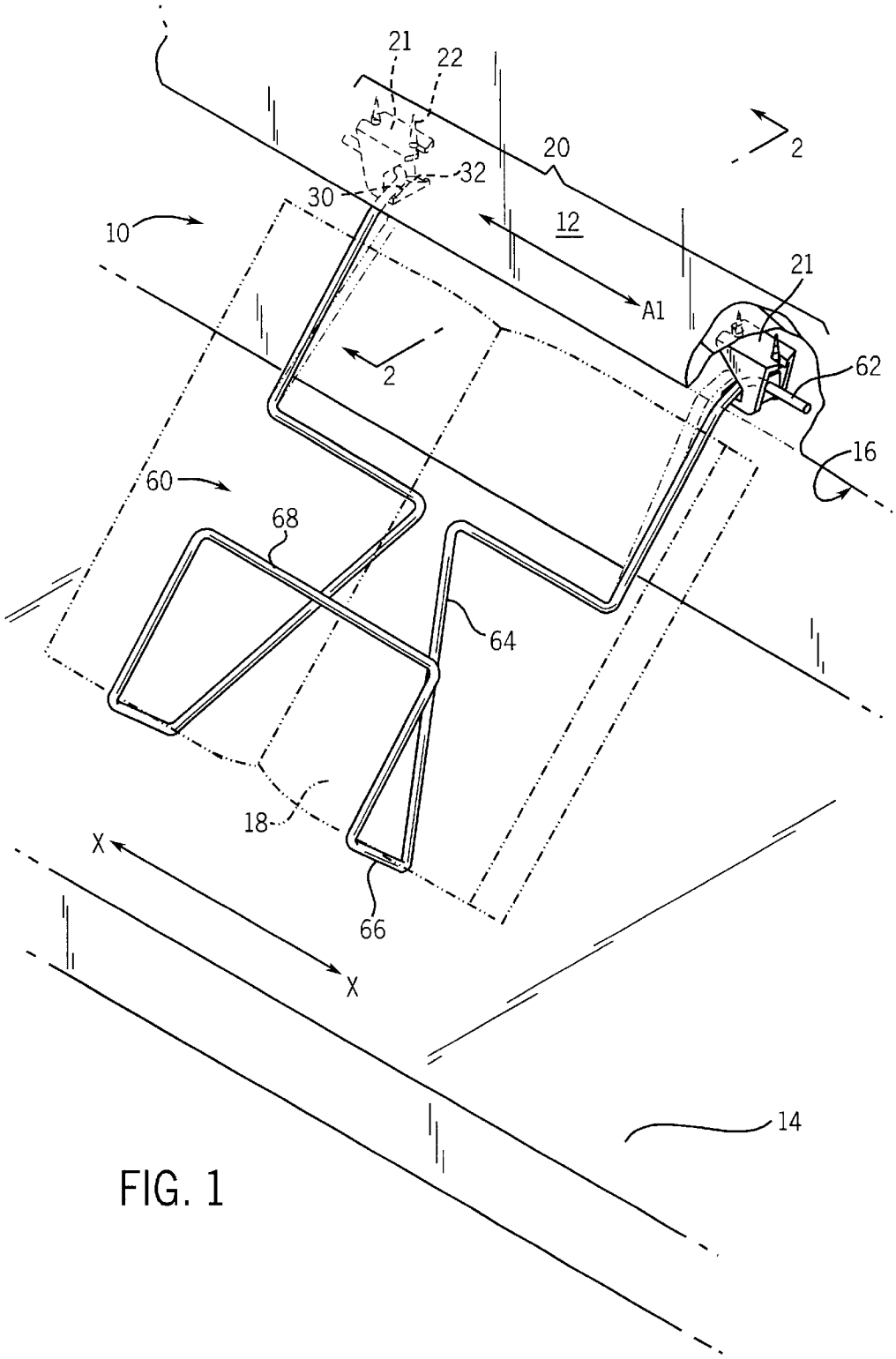
FIG. 1 is a perspective view of an apparatus for supporting articles according to an exemplary embodiment.

Referring to FIG. 1, an apparatus for supporting articles 10 is depicted in a work environment. Apparatus 10 may be used in multiple work environments including kitchens, laboratories, workshops, assembly lines, offices, cubicles, etc. The work environment includes cabinet 12 installed above a work surface 14, shown as a countertop. Apparatus 10 is shown installed on a bottom horizontal surface 16 of cabinet 12. Alternatively, apparatus 10 may be installed on any user selected surface, vertical or horizontal, which may provide easy accessibility to a user. Apparatus 10 is shown in a first "use" position such that a user may be provided access to an article (shown in phantom lines as a book 18). According to any preferred or alternative embodiment, the apparatus may be used to support a variety of other articles such as displayed information sources including books, cook books, manuals, printed documents, printed literature, references, notebooks, wire-bound documents, data or information displays, personal digital assistants or other computing devices, or other information-containing articles.

As shown in FIG. 1, apparatus 10 includes a mounting structure shown as a base 20 and a member 60 (shown as a wire frame). Base 20 is attached to surface 16 of cabinet 12 using fasteners (shown as wood screws 22). According to alternative embodiments base 20 may be attached to a user selected surface with a variety of fasteners including adhesives, nails, Velcro®, screws, bolts, etc.

In an exemplary embodiment, base 20 is a mounting structure provided by two supports 21 attachable to a frame. Alternatively, base 20 may be a single member. Supports 21 are installed relative to each other, and aligned on a width axis shown as axis X-X. Base 20 is located near an edge of cabinet 12. Alternatively, base 20 may be placed and oriented in any of a variety of available locations and directions. For example, to place an article in a position not directly in front of cabinet 12, a user may align supports 21 along an axis askew to axis X-X, allowing the user to view the article at a different angle relative to cabinet 12.

In an exemplary embodiment, supports 21 are separated by a distance along width axis X-X roughly corresponding to a width required to properly couple member 60 to base 20, as will be discussed in greater detail below.

Figure 3:
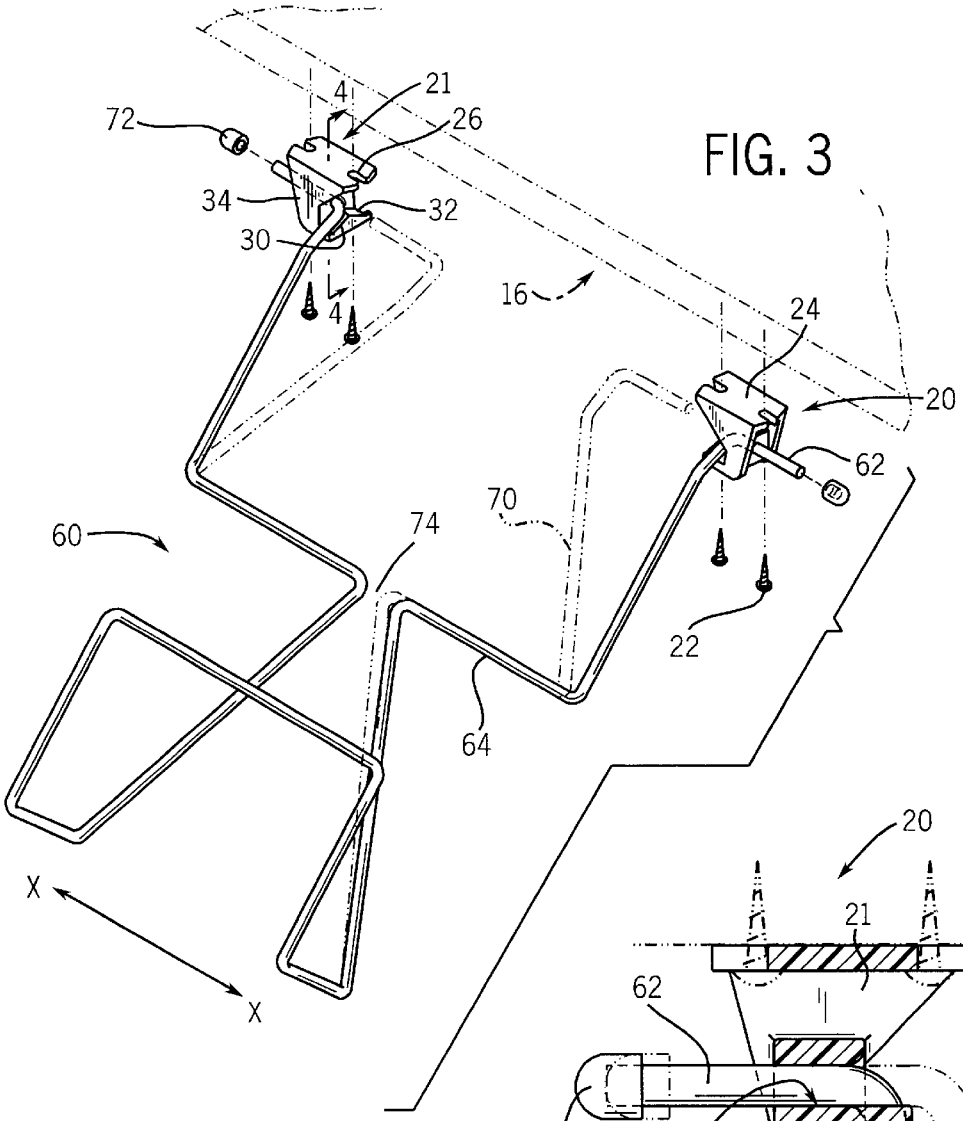
FIG. 3 is an exploded perspective view of the apparatus.
Figure 4:
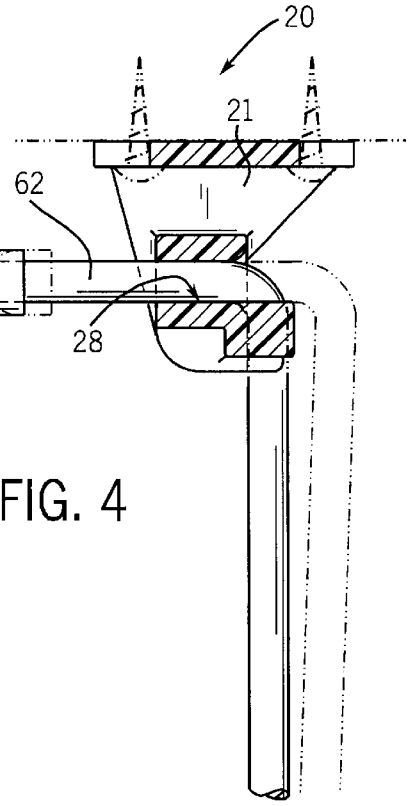
FIG. 4 is a sectional view of a support of the apparatus, taken along line 4—4 in FIG. 3.

In an exemplary embodiment shown in FIGS. 3 and 4, supports 21 each include mounting surfaces 24 disposed on a top surface of support 21, and apertures, shown as open-ended slots 26 disposed on opposing sides of mounting surface 24. Supports 21 are installed on surface 16 by abutting mounting surface 24 against the user selected surface 16, and rigidly fastening support 21 to surface 16. As shown in FIG. 3, support 21 is rigidly fastened to surface 16 by fasteners shown as wood screws 22 inserted through slots 26, and screwed into surface 16.

Support 21 further includes an aperture shown as hole 28. As depicted in FIG. 4, hole 28 is oriented substantially parallel to width axis X-X. The diameter of hole 28 is sized as to allow passage of coupling portion 62 of member 60. In an alternative embodiment, hole 28 (shown as a through hole) may be replaced with a blind hole with sufficient depth as to allow proper operation of holder 10, as will be described below.

Figure 2:
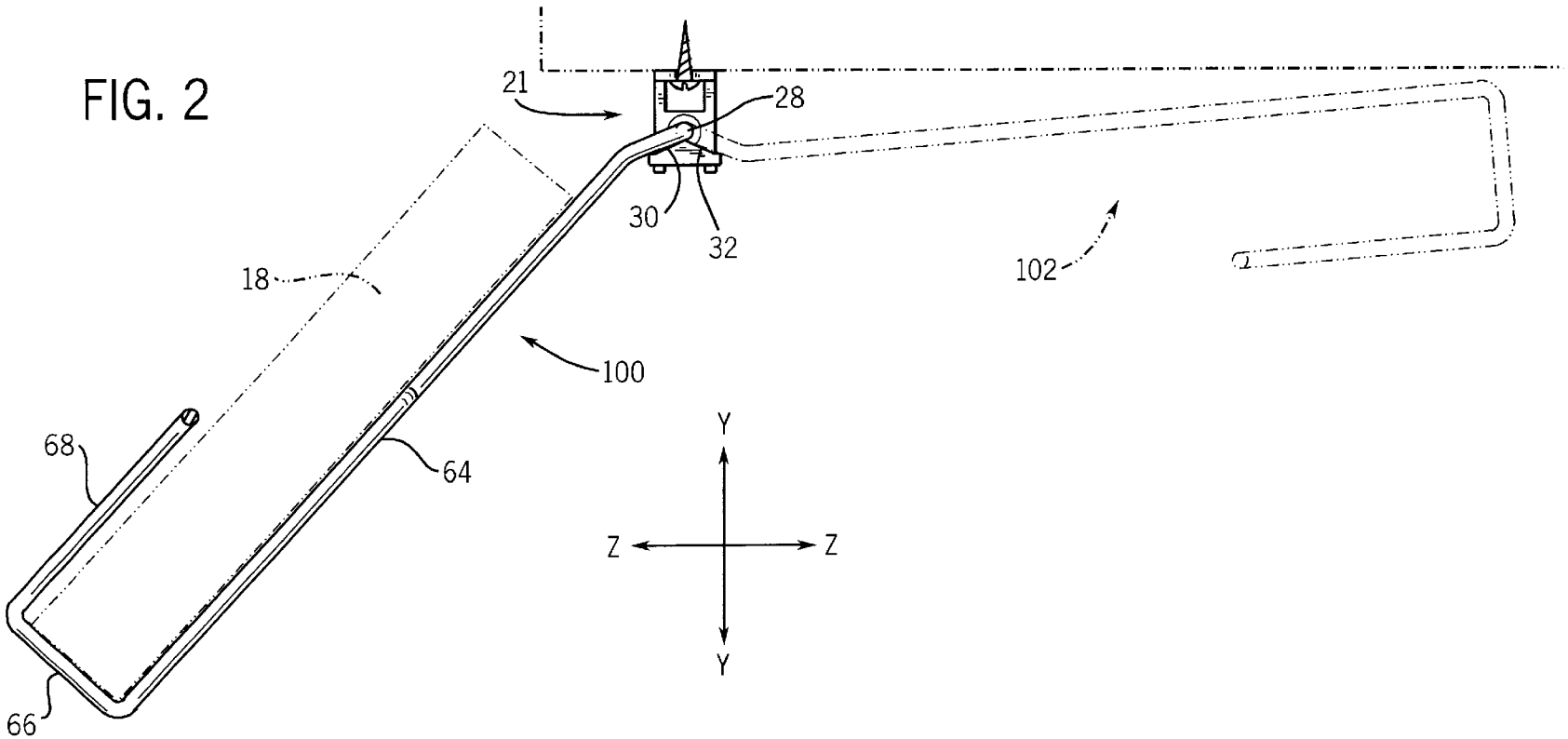
FIG. 2 is a side elevation view of the apparatus taken along the line 2—2 in FIG. 1.

Support 21 further includes first surface 30 and second surface 32. First surface 30 and second surface 32 project off body 34 of support 21. As shown in FIG. 2, first surface 30 and second surface 32 form two downward sloping ramps on support 21. First surface 30 slopes downward from aperture 28, moving left along a depth axis Z-Z. Second surface 32 slopes downward from aperture 28, moving right along a depth axis Z-Z. Referring to FIG. 3, first surface 30 and second surface 32 have a width along width axis X-X sufficient to provide a surface for member 60 and end portion 70 to rest on, as will be discussed in further detail below.

In an exemplary embodiment, base 20 includes two supports 21. Support 21 is a single body constructed from molded acetal resin. Alternatively, support 21 may be machined, formed, molded, shaped, cut, etc. out of a variety of materials including wood, metals and metal alloys, steel, polymers, composites, etc.

Figure 5:
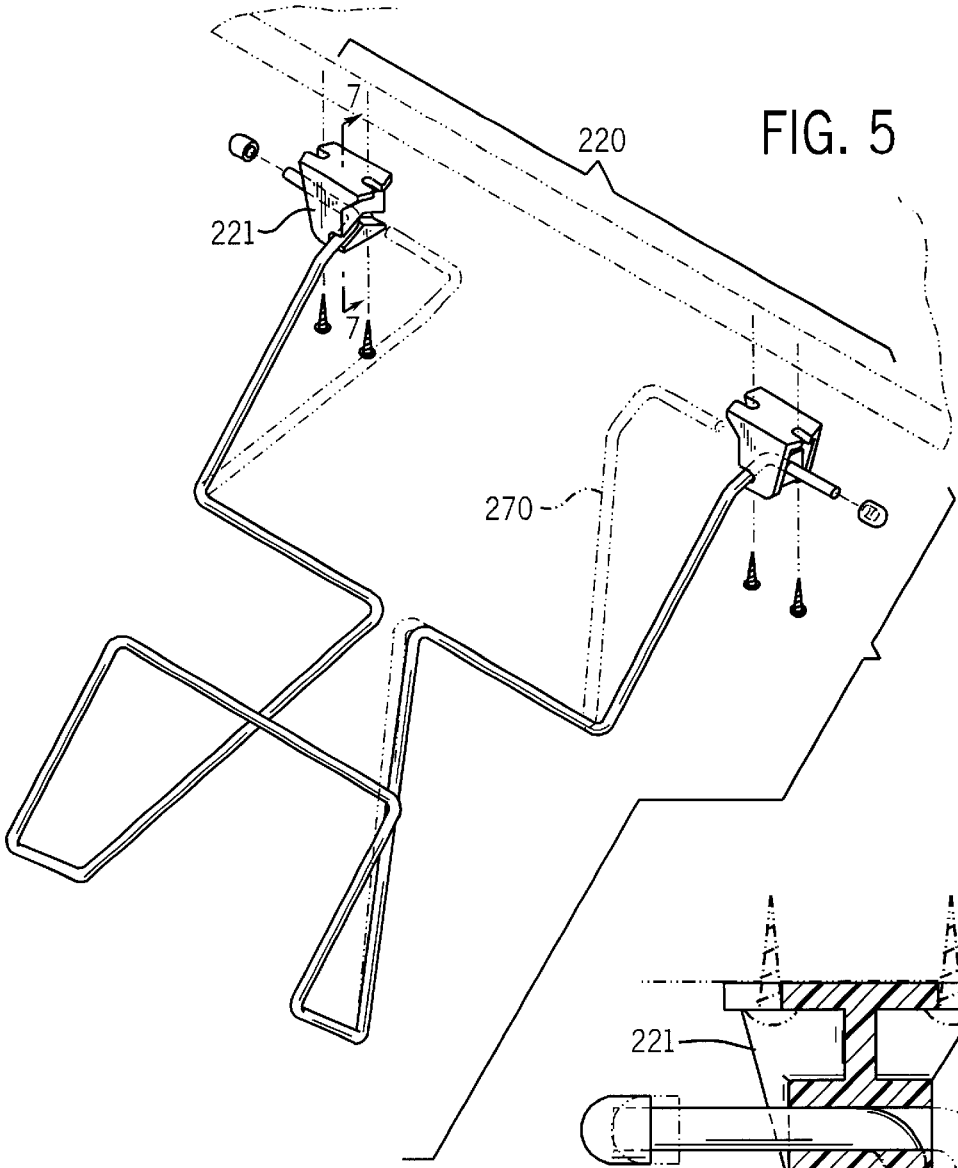
FIG. 5 is an exploded perspective view of an alternative embodiment of an apparatus for supporting articles.
Figure 7:
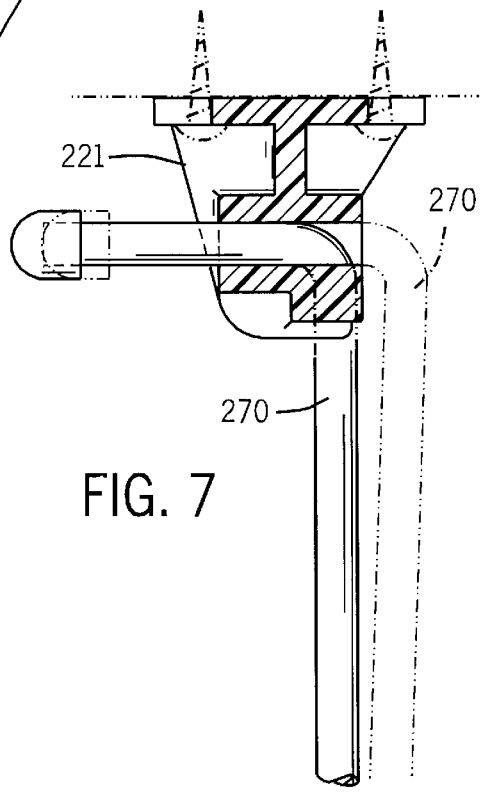
FIG. 7 is a sectional view of a support of the apparatus, taken along the line 7—7 in FIG. 5.
Figure 6:
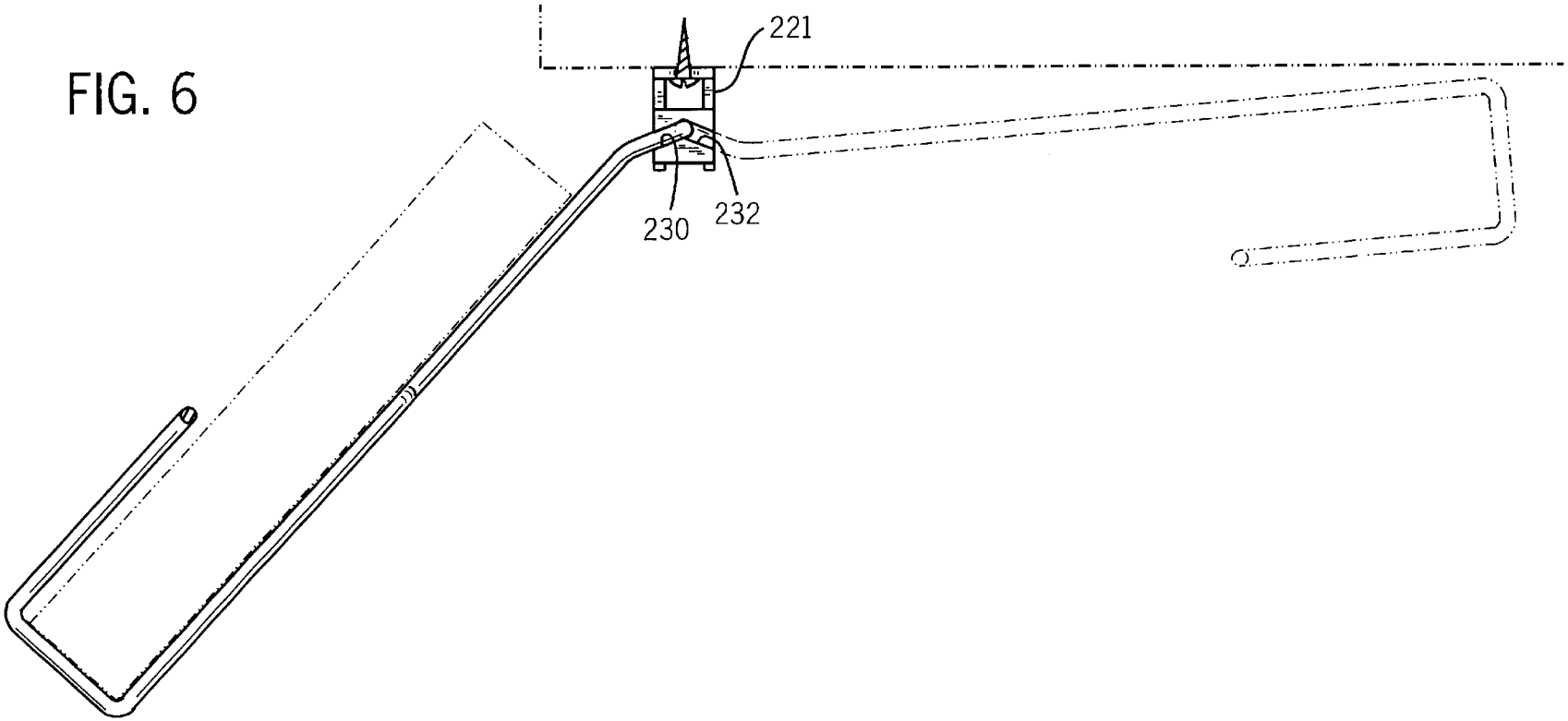
FIG. 6 is a side elevation view of the apparatus of FIG. 5.

Alternatively, base 20 may be any other type of bracket, support, or mounting member. For example, an alternative base 220 is shown in FIGS. 5–7. Support 221 is similar to support 21 shown in FIGS. 1–4. Support 221 includes a first notch 230 and a second notch 232. First notch 230 and second notch 232 are sized to receive end portion 270 in an assembled condition. Notches 230 and 232 operate to constrain rotational motion when end portion 270 is engaged in first notch 230 or second notch 232.

As shown in FIG. 1, apparatus 10 further includes member 60. Member 60 is configured to support and hold information source 18. In an exemplary embodiment shown in FIG. 3, member 60 includes various portions that are formed to provide support for article 18.

As shown in FIGS. 2–3, member 60 includes back portion 64, bottom portion 66, front portion 68, and coupling portion 62. Back portion 64 substantially supports a back side of article 18 (shown as a book) against the force of gravity (generally acting parallel to vertical axis Y-Y). Bottom portion 66 supports an edge of article 18 against sliding off of back portion 64. Front portion 68 is configured to retain article 18 and thereby constrict movement. As shown in FIG. 1, when article 18 is a book, front portion 68 also constrains movement of the pages of the book. For example, an open spine bound book may have pages that tend to flip closed due to forces generated in the spine. Front portion 68 retains the pages in an open condition so a user can refer to the proper, selected pages.

Member 60 may be constructed from a single body. In an exemplary embodiment, member 60 is a single steel wire which has been bent to achieve the overall general shape shown in FIG. 1. In an exemplary embodiment, member 60 is constructed using 0.177 inch diameter steel. In alternative embodiments, member 60 may be constructed using other types of steel rods, other metals and metal alloys, polymers, and other suitable materials. Furthermore, member 60 may be constructed using a variety of other diameters such that they are capable of providing adequate support for information display source 18 and further providing sufficient flexibility for coupling to and decoupling from base 20. Furthermore, member 60 may be constructed from multiple pieces and joined by welding, soldering, gluing, etc.

The installation, operation and use of apparatus 10 will be described herein with reference to the use of a book. It should be noted at the outset that the operation and use of apparatus 10 is not limited only to books and printed media, but apply also to any form of information sources.

Base 20 is attached to a user selected surface according to any method described above. In an exemplary embodiment, supports 21 are attached to a surface 16 of cabinet 12. Supports 21 are aligned along width axis X-X, thereby forming a plane in which a book will be viewable by a user. The orientation of axis X-X is selected by a user based on the various requirements of the workspace. Supports 21 are separated by a distance (along axis X-X) roughly corresponding to the distance between coupling portions 62.

Once supports 21 are rigidly coupled to surface 16 of cabinet 12, member 60 is then coupled to supports 21. As shown in FIG. 4, coupling portion 62, disposed on ends of end portion 70, is sized to fit into aperture 28. As shown in FIG. 3, support 60 is elastically deformed by moving end portions 70 toward each other, thereby reducing the distance between end portions 70 as well as shortening the distance of gap 74. Once end portions 70 have been moved toward each other a sufficient distance, and gap 74 has been shortened sufficiently, coupling portions 62 are inserted into apertures 28 of supports 21, and member 60 substantially returns to its original shape.

In an alternative embodiment, member 60 may be fitted with retainers 72 (FIGS. 3–4 shown as end caps). After installation of supports 21 and member 60, retainers 72 are installed on coupling portion 62 of member 60. Retainers 72 prevent or provide resistance to end portion 70 from completely disengaging out of aperture 28 in support 21.

Alternatively, member 60 may be inserted into supports 21, and then supports 21 may then be rigidly coupled to bottom horizontal surface 16 of cabinet 12.

Once assembled, apparatus 10 may be selectively positioned between a first position 100, and a second position 102 (FIG. 2). In a preferred embodiment position 100 is a "use" position and position 102 is a "concealed" or "stowed" position. However, first position 100 and second position 102 may be any other type of position such as a first and second use position. In an exemplary embodiment, member 60 is moved from first position 100 to second position 102 by simultaneously disengaging end portions 70 from first surfaces 30. Once disengaged, member 60 is free to rotate around an axis A1 (FIG. 1), an axis coincident with the alignment of apertures 28. Member 60 is rotated towards second position 102 (shown as counter-clockwise in FIG. 2). Once member 60 is in second position 102, end portion 70 is engaged on second surfaces 32. In an exemplary embodiment, end portion 70 is selectively engaged and disengaged from surfaces 30 and 32 by causing member 60 to be compressed or deformed. In a preferred embodiment, compression or deformation is elastic, and member 60 returns to substantially the same shape after removal of such forces. By compressing or deforming member 60, end portion 70 is disengaged from surfaces 30 or 32 thereby allowing rotation of member 60 between first position 100 and second position 102.

As shown in FIG. 2, when member 60 is in position 100, a user may view article 18. In position 102, member 60 is concealed under cabinet 12 in a stowed or stored position.

Although only a few exemplary embodiments of the information display system have been described in detail above, those skilled in the art who review this disclosure will readily appreciate that many modifications are possible in the exemplary embodiments without materially departing from the novel teachings and advantages of the present invention. For example, in an exemplary embodiment, supports 21 are shown oriented with support surfaces 30 and 32 facing inwards with respect to each other. Alternatively, supports may be oriented with the support surfaces facing outwards with respect to each other, and the member may be altered such that the coupling portion is oriented inwards.

Accordingly, all such modifications are intended to be included within the scope of the invention as defined in the following claims. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred embodiments without departing from the scope of the invention as expressed in the appended claims.

What is claimed is:

1. An apparatus for supporting an article underneath a cabinet, comprising:

a base having a first surface and a second surface, the base being attached to and fixed against rotation relative to the cabinet; and a member rotatably coupled to the base, the member configured to support the article;

wherein the member may be selectively positioned from a first position to a second position by movement of the member relative to the base, and the base being configured such that the member rests on top of the first surface in the first position, and the member rests on top of the second surface in the second position.

2. The apparatus of claim 1, wherein the first position is a use position.

3. The apparatus of claim 1, wherein the second position is a stowed position.

4. The apparatus of claim 1, wherein the member is configured to be selectively rotatably positioned relative to the base.

5. The apparatus of claim 4, wherein the member is configured to be disengaged from the first surface, rotated from the first position to the second position, and engaged on the second surface.

6. The apparatus of claim 4, wherein the first surface includes a first notch configured to support the member in the first position, and the second surface includes a second notch configured to support the member in the second position.

7. The apparatus of claim 1, further comprising at least one retainer disposed on an end of the member, wherein the retainer is configured to prevent the member from disengaging the mount.

8. The apparatus of claim 1, wherein the member is configured to support a book.

9. The apparatus of claim 1, wherein the member is configured to hold opened pages of a book.

10. The apparatus of claim 1, wherein a user selected surface is a bottom side of a horizontal surface.

11. A holder comprising:

first and second bracket configured to fixedly attached to a cabinet;

first surfaces coupled to the first bracket and the second bracket;

second surfaces coupled to the first bracket and the second bracket;

a member rotatably coupled to the first and second brackets, the member configured to be selectively positioned from a first position to a second position;

wherein the member rest on top of the first surfaces of the brackets in the first position, and rest on top of the second surfaces of the brackets in the second position.

12. A holder comprising:

first and second brackets configured to be coupled to a horizontal surface;

first surfaces coupled to the first bracket and the second brackets, the bracket;

second surfaces coupled to the first bracket and the second bracket;

a member rotatably coupled to the first and second member configured to be selectively positioned from a first to a second position, and the member being adapted to disengage from the first surfaces, the member being adapted to move from the first position to the second position, and the member being adapted to engage with the second surfaces;

wherein the first surfaces support the member from below the member in the first position, and the second surfaces support the member from below the member in the second position.

13. The holder of claim 12, wherein the member is configured to deform in order to disengage the member from the first surfaces, and to engage the member with the second surfaces.

14. The holder of claim 13, wherein the member configured to deform, deforms elastically.

15. The holder of claim 13, further comprising retainers disposed on ends of the member, wherein the retainers are configured to allow the member to be selectively engaged and disengaged from the first and second surfaces, and the retainers are configured to prevent the member from disengaging from the brackets.

16. A holder comprising:

first and second brackets configured to be coupled to a horizontal surface;

first surfaces coupled to the first bracket and the second bracket;

second surfaces coupled to the first bracket and the second bracket;

a member rotatably coupled to the first and second brackets, the member configured to be selectively positioned from a first to a second position;

wherein the first surfaces are configured as ramps and support the member in the first position, and the second surfaces support the member in the second position.

17. A holder comprising:

first and second brackets configured to be coupled to a horizontal surface;

first surfaces coupled to the first bracket and the second bracket;

second surfaces coupled to the first bracket and the second bracket;

a member rotatably coupled to the first and second bracket, the member configured to be selectively positioned from a first to a second position;

wherein the second surfaces are configured as ramps and support the member in the second position, and the first surfaces support the member in the first position.

18. The holder of claim 11, wherein the first surfaces are configured as notches.

19. The holder of claim 11, wherein the second surfaces are configured as notches.

20. The holder of claim 11, wherein both brackets are configured to be coupled to a bottom surface of a cabinet.

21. A method of using a book holder, comprising:

disengaging a book support in a stowed position from a base fixedly attached a cabinet, wherein the book support rests on top of a first surface of the base;

rotating the book support from the stowed position to a use position; and engaging the book support in the use position with the base, wherein the book support rests on top of a second surface of the base.

22. The method of claim 21, wherein disengaging the book support further comprises altering the shape of the book support.

23. The method of claim 22, wherein altering the shape of the book support further comprises elastically deforming the book support.

24. The method of claim 21, further comprising configuring the book support for a book.

25. The method of claim 21, wherein the stowed position is under a cabinet.

26. The method of claim 21, wherein disengaging the book support further comprises partially withdrawing a coupling portion of the book support from an aperture in a mount, the coupling portion being disposed on an end of the book support.

* * * * *

UNITED STATES PATENT AND TRADEMARK OFFICE

CERTIFICATE OF CORRECTION

PATENT NO. : 6,619,609 B2
DATED : September 16, 2003
INVENTOR(S) : David R. Cress It is certified that error appears in the above-identified patent and that said Letters Patent is hereby corrected as shown below:

Column 6,
Line 27, please delete "brackets, the bracket;" and insert -- bracket; --.
Lines 30-31, please delete "first and second member configured to be" and insert -- first and second brackets, the member configured to be --.

Column 7,
Line 9, please delete "bracket," and insert -- brackets, --.

Signed and Sealed this

Thirtieth Day of December, 2003

JAMES E. ROGAN
*Director of the United States Patent and Trademark Office*